US008721293B2

(12) United States Patent
Arilla et al.

(10) Patent No.: US 8,721,293 B2
(45) Date of Patent: May 13, 2014

(54) TURBINE WHEEL WITH AN AXIAL RETENTION SYSTEM FOR VANES

(75) Inventors: Jean-Baptiste Arilla, Lanne (FR); Michel Beaucoueste, Arthez d'Asson (FR); Denis Chanteloup, Gelos (FR); Michel Clastre, Morlaas (FR)

(73) Assignee: Turbomeca, Bordes (FR)

( * ) Notice: Subject to any disclaimer, the term of this patent is extended or adjusted under 35 U.S.C. 154(b) by 360 days.

(21) Appl. No.: 13/140,078

(22) PCT Filed: Dec. 16, 2009

(86) PCT No.: PCT/FR2009/052553
§ 371 (c)(1),
(2), (4) Date: Jun. 16, 2011

(87) PCT Pub. No.: WO2010/076493
PCT Pub. Date: Jul. 8, 2010

(65) Prior Publication Data

US 2011/0250071 A1 Oct. 13, 2011

(30) Foreign Application Priority Data

Dec. 17, 2008 (FR) ..... 08 58689

(51) Int. Cl.
*F01D 5/30* (2006.01)

(52) U.S. Cl.
USPC ..... 416/220 R

(58) Field of Classification Search
CPC ..... F01D 5/3015
USPC ..... 416/220 R
See application file for complete search history.

(56) References Cited

U.S. PATENT DOCUMENTS 3,728,042 A * 4/1973 Hugoson et al. ..... 416/220 R
4,086,757 A 5/1978 Karstensen et al.

(Continued)

FOREIGN PATENT DOCUMENTS

EP 1 498 579 1/2005
EP 1 845 235 10/2007

(Continued)

OTHER PUBLICATIONS

International Search Report issued May 11, 2010 in PCT/FR09/52553 filed Dec. 16, 2009.

(Continued)

*Primary Examiner* — Richard Edgar
(74) *Attorney, Agent, or Firm* — Oblon, Spivak, McClelland, Maier & Neustadt, L.L.P.

(57) ABSTRACT

A turbine wheel includes: a plurality of blades, a rotor including a disk having the blades mounted at a periphery thereof, each blade including an airfoil with a foot secured to a platform carrying an attachment member engaged in a housing that opens into the periphery of the disk and that extends axially between two opposite side faces of the disk, the housings being spaced apart from one another by portions of the disk that form teeth, and an axial retention plate retaining the blades on the disk and including a retention plate situated on one side of the disk. On the other side of the disk, the teeth of the disk present portions in relief that project radially and that form abutments pressing axially against the portions in relief that are formed under the platforms of the blades and that are set back relative to side faces of the attachment members situated beside a second side face of the disk, and side faces of the attachment members of the blade and of the disk at its periphery are situated in substantially a same plane on each side of the disk.

8 Claims, 4 Drawing Sheets

(56) References Cited

U.S. PATENT DOCUMENTS

| | | | | | |
|---|---|---|---|---|---|
| 4,304,523 | A | * | 12/1981 | Corsmeier et al. | 416/220 R |
| 4,940,389 | A | | 7/1990 | Luxenburger | |
| 5,302,086 | A | * | 4/1994 | Kulesa et al. | 416/220 R |
| 5,993,160 | A | | 11/1999 | Bouchard et al. | |
| 6,077,035 | A | | 6/2000 | Walters et al. | |
| 2005/0042108 | A1 | | 2/2005 | Benderradji et al. | |
| 2007/0237645 | A1 | | 10/2007 | Garin et al. | |

FOREIGN PATENT DOCUMENTS

| | | |
|---|---|---|
| JP | 2001-526345 | 12/2001 |
| WO | 99 30008 | 6/1999 |
| WO | 99 50534 | 10/1999 |

OTHER PUBLICATIONS

U.S. Appl. No. 13/139,109, filed Jun. 10, 2011, Chanteloup.

* cited by examiner

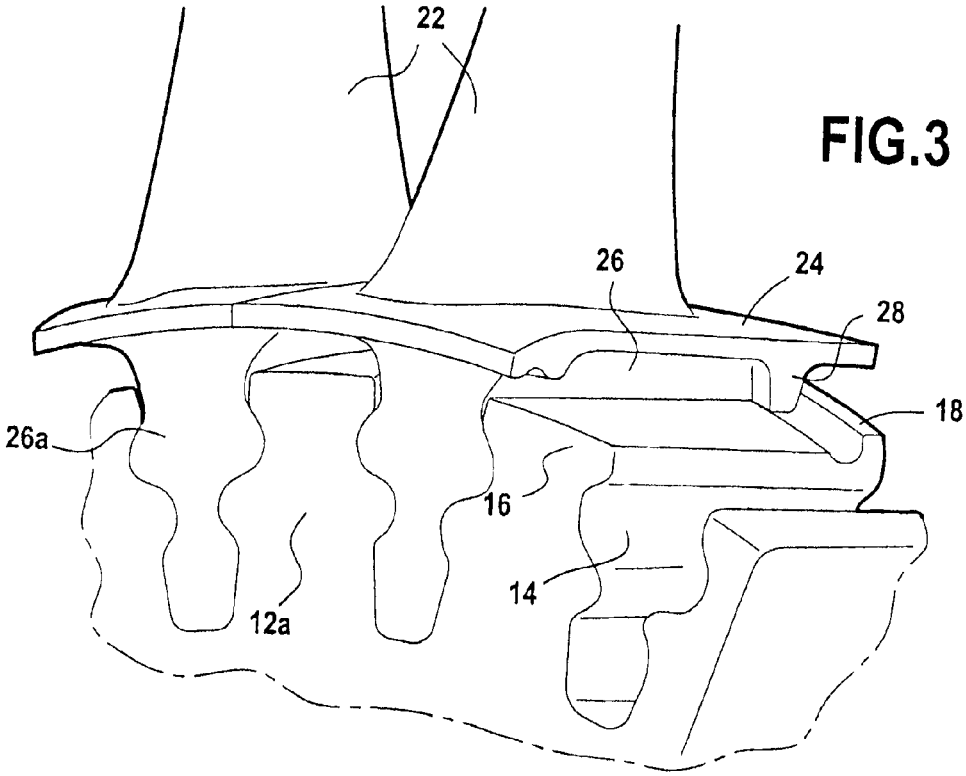
FIG.3
FIG.4
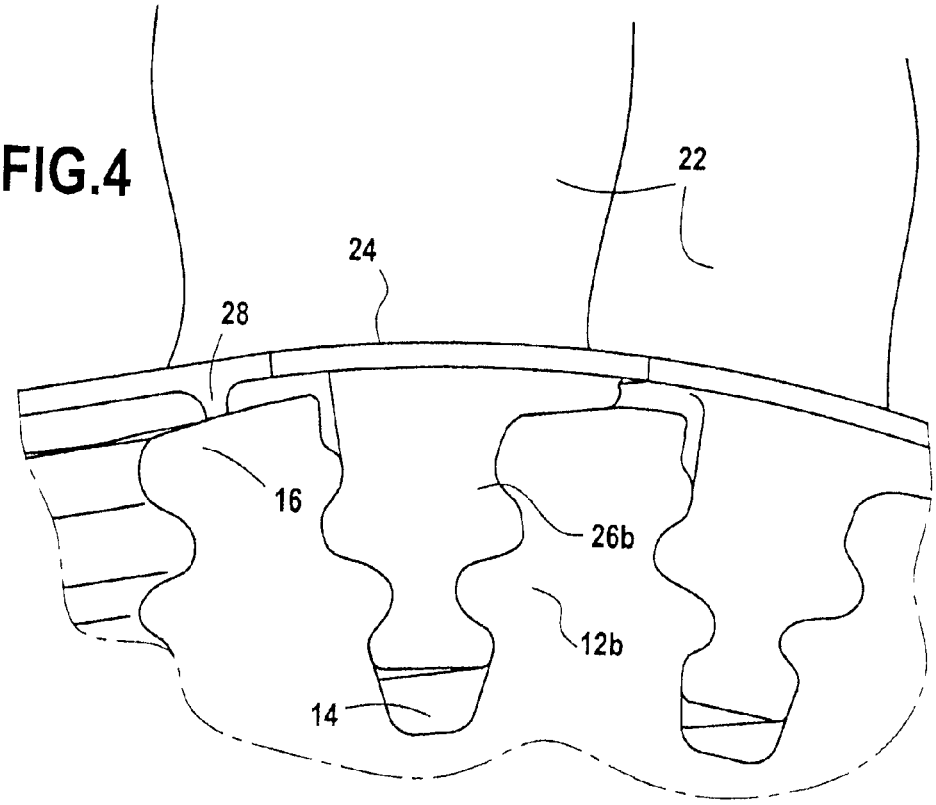

TURBINE WHEEL WITH AN AXIAL RETENTION SYSTEM FOR VANES

The invention relates in general to turbine wheels in gas turbines, and it relates more particularly to axially retaining blades carried by the wheels. The field of application of the invention is in particular that of industrial gas turbines or gas turbine aeroengines.

In a turbine wheel, the blades are mounted at the periphery of a disk, each blade having an airfoil with a foot that is secured to an attachment member that is engaged axially in a housing or slot that opens into the periphery of the disk and that extends between two opposite faces of the disk.

Axial retention devices for blades are necessary to prevent any axial movement due to vibration or to thermal effects and in spite of the pressure that is generated by centrifugal force between the contacting surface portions of the blade attachment members and the housings in the disk.

Known axial retention devices make use of plates carried by the rotor and pressing against upstream (front) and downstream (rear) side faces of the blade attachment members. It is also known from documents WO 99/50534 and WO 99/30008 to use a single plate that presses against the attachment members of the blades on the upstream side, and, on the downstream side, to use a continuous circumferential abutment formed on the disk and pressing against portions in relief formed under the platforms of the blades at the downstream side. In order to reduce overall size, the length of the attachment members (in the axial direction) could be made shorter than that of the housings, with the downstream face of the attachment members being set back from the downstream face of the disk. However the trailing edge of the airfoil of the blade would then be cantilevered-out relative to the attachment member, which member would then be subjected to bending stresses that might weaken it.

An object of the invention is to provide a turbine wheel provided with a system for axially retaining blades that presents minimum overall size without giving rise to excessive loading on the attachment members of the blades.

This object is achieved by a turbine wheel comprising:

a plurality of blades;

a rotor with a disk having opposite side faces and having the blades mounted at its periphery, each blade having an airfoil with a foot secured to a platform carrying an attachment member having opposite side faces and engaged in a housing opening out into the periphery of the disk, the housings being separated from one another by portions of the disk that form teeth; and axial retaining devices for retaining the blades on the disk, the blades being retained axially at a first one of the upstream and downstream sides of the disk by means of a retaining plate and being retained axially at the other or second side of the disk by a portion in relief that projects radially from the periphery of the disk and that presses against portions in relief formed under the platforms of the blades;

in which turbine wheel, the housings for the attachment members of the blades extend axially over the entire distance between the opposite side faces of the disks, and at the second side of the disk, the blades are retained axially by the portions in relief formed under the platforms of the blades pressing axially against portions in relief formed on the teeth of the disk, the axial pressure being set back relative to the side faces of the attachment members situated on the second side of the disk, and the side faces of the attachment members of the blades and of the disk at the periphery thereof are situated substantially in a same plane.

Thus, advantageously, axial overall size is minimized and the trailing edge at the base of each airfoil need not be significantly cantilevered-out relative to the attachment member of the airfoil.

Preferably, axial pressure between a blade and a corresponding tooth of the disk is applied substantially level with the suction side face of the airfoil, and under the foot of the airfoil.

Preferably, the retaining plate exerts axial pressure on the side faces of the teeth of the disk or of the attachment members of the blades. The retaining plate advantageously presents a radial dimension that is limited so as to press solely against the bottom portions of the teeth of the disk or of the attachment members of the blades.

Axial pressure may advantageously be provided and maintained between the blades and the rotor without encroaching on the radial clearance between the rotor and an adjacent stator.

Advantageously, the retaining plate presents extra thickness at its periphery forming a cantilevered-out mass. During rotation, it is thus possible to avoid the plate opening and giving rise to a loss of pressure from the plate.

The retaining plate may press against the side faces of the teeth of the disk or of the attachment members of the blades with prestress.

The retaining plate may be mounted on the rotor, while being held axially by means of a retaining split ring.

Advantageously, at least one opening forming an inspection window is formed in the rotor to enable the positioning of the retaining split ring to be inspected visually.

The invention also provides a turbomachine including a turbine wheel according to the invention.

The invention can be better understood on reading the following description made with reference to the accompanying drawings, in which:

FIGS. 3 and 4 are fragmentary perspective views showing how blades are mounted in the disk of the FIG. 1 turbine wheel.

Figure 1:
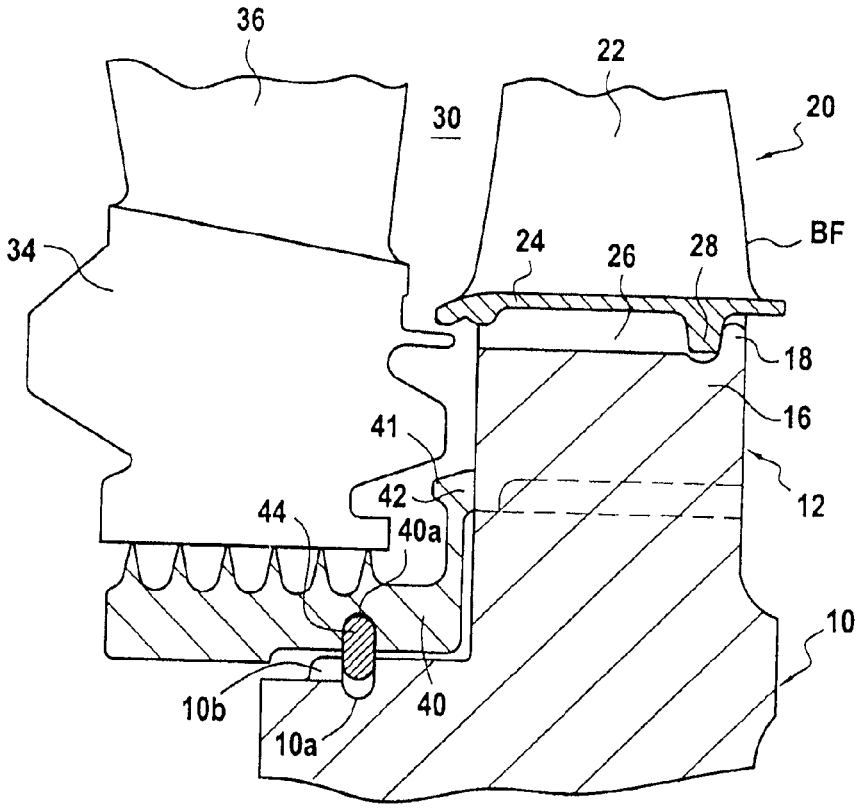
FIG. 1 is a fragmentary axial half-section view of a turbine wheel in an embodiment of the invention.

FIG. 1 shows a turbine rotor 10, e.g. a high pressure (HP) turbine rotor in a gas turbine engine. The rotor 10 is secured to a disk 12 carrying a plurality of blades 20 at its periphery.

Figure 2:
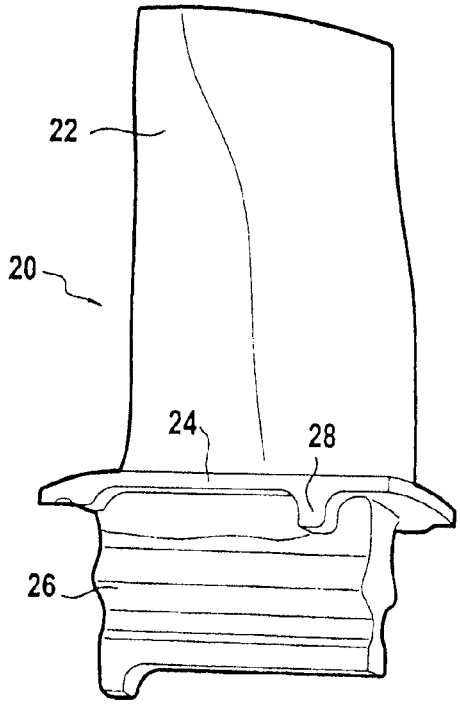
FIG. 2 is a perspective view of a blade of the FIG. 1 wheel.

Each of the blades 20 (see also FIGS. 2-4) comprises an airfoil 22 that extends in the annular passage 30 for the stream of gas passing through the turbine, which passage is defined on the outside by a turbine ring (not shown) adjacent to the tips of the blades.

Each blade 20 has its foot secured to a platform 24 that carries an attachment member (or tang) 26 serving to connect the blade to the disk 12. In the example shown, the attachment member has a fir-tree shaped profile. The platforms 24 of the blades define the passage 30 on the internal side.

The attachment members 26 are engaged axially in housings (or slots) 14 of complementary shape that are distributed around and open to the periphery of the disk 10. The housings 14 extend axially over the entire distance between the upstream (or front) side face 12*a* and the downstream (or rear) side face 12*b* of the disk, and they are separated from one another by teeth 16 of the disk. The terms "upstream" and "downstream" are used herein relative to the flow direction of the gas stream through the turbine.

Downstream, the blades 20 are retained axially by contact with pressure between portions 28 in relief in the form of studs formed on the bottom faces of the platforms 24 and abutments or stops 18 in the form of studs projecting from the downstream sides of the teeth 16 of the disk. The studs 28 extend circumferentially from one of the longitudinal faces of the attachment members 26 and they are set back relative to the downstream side faces of the attachment members 26. Contact between the portions in relief 28 and the abutments 18 is advantageously positioned substantially level with the suction sides of the airfoils 22, beneath the feet of the airfoils. One or more portions in relief 28, e.g. two portions in relief in circumferential alignment, may be formed on the bottom face of the platform 24 of a blade 20 so as to press against an abutment 18 in the form of a stud. Likewise, a portion in relief 28 in the form of a stud made on the bottom face of the platform 24 of a blade 20 may come to press against a plurality of abutments 18 formed on a corresponding tooth 16 of the disk, e.g. two teeth 18 in circumferential alignment.

As shown in FIGS. 3 and 4, the attachment members 26 extend all along the housings 14 and the upstream and downstream side faces 26*a* and 26*b* of the attachment members lie in substantially the same planes as the upstream and downstream side faces 12*a* and 12*b*, respectively, at the periphery of the disk 12. Thus, the trailing edges BF at the bottom ends of the airfoils 22 are substantially not cantilevered out relative to the attachment members 26 of the blades, so no overloading is generated on the attachment members 26 at their downstream sides.

Figure 5:
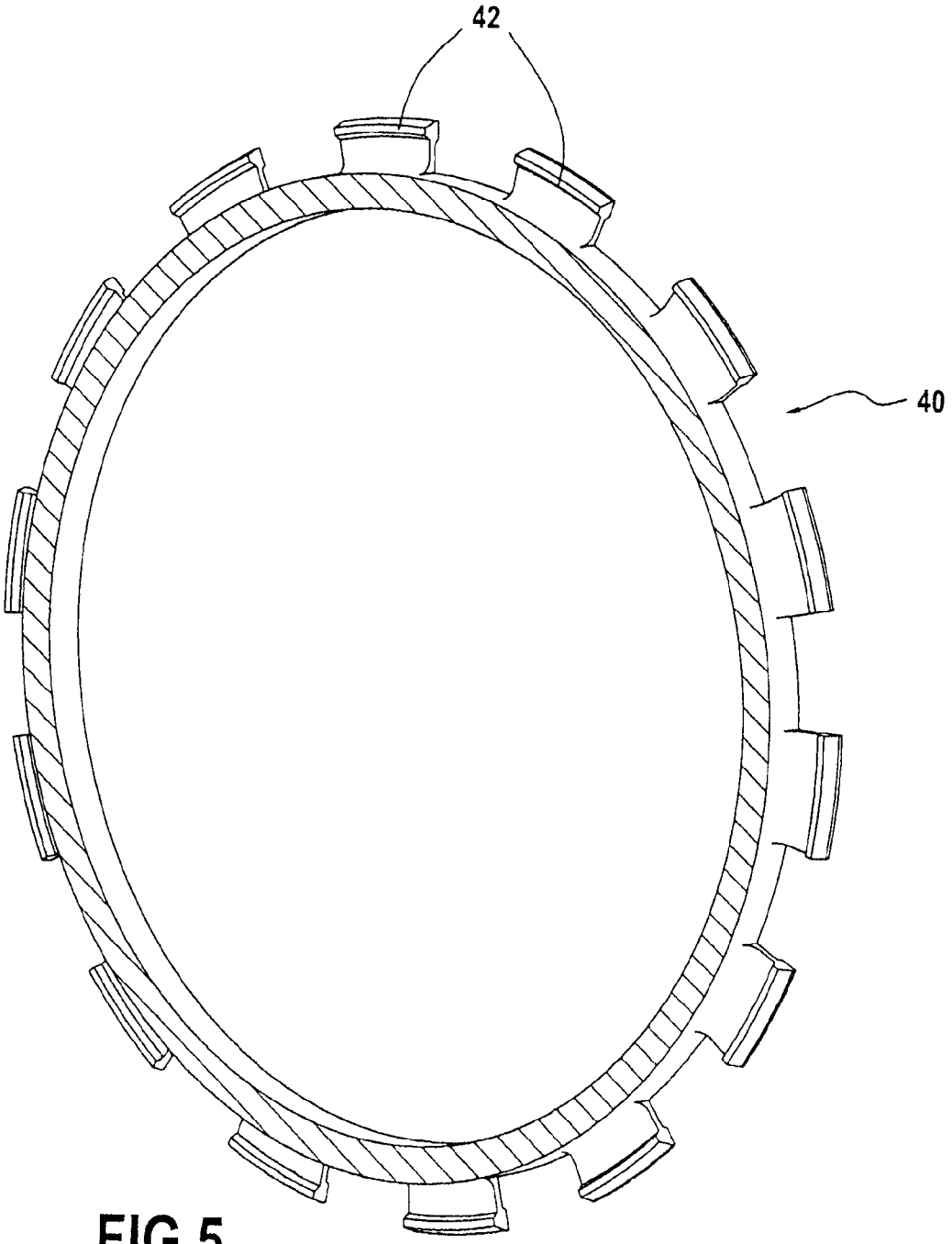
FIGS. 5 and 6 are diagrammatic perspective views of two embodiments of the retaining plate of the FIG. 1 turbine wheel.

Upstream, axial retention of the blade is provided by a plate 40. In the embodiment of FIG. 5, the plate 40 presents teeth 42 that project and that press laterally against the upstream side faces 26*a* of the attachment members 26, without making contact with the upstream side face 12*a* of the disk 12.

Figure 6:
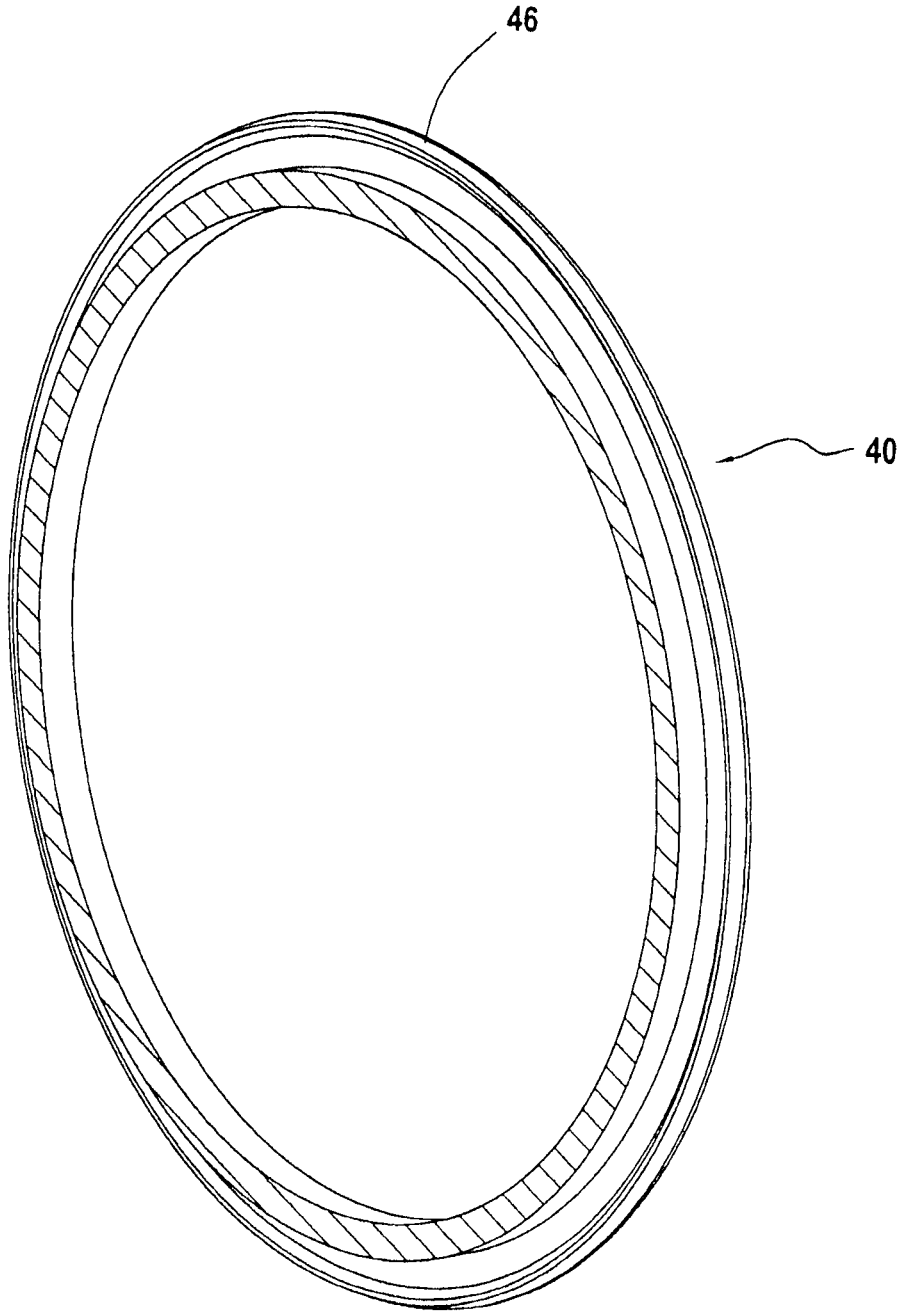

In the embodiment of FIG. 6, the plate 40 presents a continuous projecting peripheral rim 46 that presses laterally against the upstream side face 12*a* of the disk 12 at the level of the teeth 16. The plate 40 may then be mounted with axial prestress so as to guarantee bearing pressure of the teeth 42 against the teeth 16 of the rotor. Naturally, the axial dimensions of the attachment members 26 and of the teeth 16 are such that, at the upstream side, the attachment members 26 do not project from the plane of the upstream face 12*a* of the disk 12 at the level of its teeth 12.

Advantageously, the plate 40 comes to press solely against the bottom portions of the teeth 16 or of the attachment members 26. The radial size of the plate 40 is thus limited, thus making it possible to avoid potential contact in operation with a stator 34 carrying the vanes 36 of a nozzle upstream from the turbine wheel.

Thus, achieving axial pressure between the blades 20 and the disk 12 and maintaining this pressure by means of the plate 40 does not give rise to encroaching on any axial clearance between the disk and a stator that is adjacent upstream or downstream, i.e. does not determine the size of said axial clearance.

Also advantageously, the retaining plate 40 presents extra thickness 41 at its periphery forming a cantilevered-out mass going away from its face pressing against the teeth 16 or the attachment members 26. This avoids the peripheral portion of the plate opening, with a loss of pressure against the teeth 16 or the attachment members 26 under the effect of the deformation induced by rotation.

In the example shown in FIG. 1, the axial retention plate 40 is mounted on the rotor 10 while being held axially by a split ring 44 that is engaged in an annular groove 10*a* formed in the rotor and in an annular groove 40*a* formed in the inside face of the plate 40. On assembly, the split ring 44 is put into place in the groove 10*a* and it is retracted into the groove to allow the plate 40 to be mounted in a press. In operation, centrifugal forces hold the split ring 44 in the groove 40*a* of the plate, thereby preventing it from moving axially.

One or more passages or grooves constituting inspection windows 10*b* are advantageously formed radially in the rotor 10 so as to open out firstly in a radial face 10*c* of the rotor and secondly in the groove 10*a*. The inspection windows 10*b*, optionally while using an endoscope, serve to verify the proper positioning of the split ring 44.

Other ways of mounting the plate 40 on the rotor 10 with axial blocking could be adopted, e.g. a bayonet mount.

The arrangements of the axial retention means of the blades could be reversed, with abutments formed on the upstream faces of the teeth of the disk co-operating with studs formed on the platforms of the blades, and a retaining plate situated on the downstream side and exerting pressure against the downstream side faces of the teeth or attachment members of the blades.

The invention claimed is:

1. A turbine wheel comprising:

a plurality of blades;

a rotor including a disk having opposite upstream and downstream side end faces at a periphery of the disk and including the blades mounted at the periphery of the disk, each blade including an airfoil with a foot secured to a platform carrying an attachment member having opposite upstream and downstream side end faces and engaged in a housing opening out into the periphery of the disk, the housings extending axially over an entire distance between the opposite upstream and downstream side end faces of the periphery of the disk and being separated from one another by portions of the disk that form teeth; and axial retaining devices for retaining the blades on the disk, the blades being retained axially at a first one of the upstream and downstream side end faces of the disk by a retaining plate and being retained axially at a second other of the upstream and downstream side end faces of the disk by portions in relief formed under the platforms of the blades pressing axially against portions in relief formed on the teeth of the disk, wherein an axial pressure is set back relative to the side faces of the attachment members situated on the second side end face of the disk, wherein the upstream and downstream side end faces of the attachment members of the blades and of the disk at the periphery thereof are situated substantially in a same plane on each of the upstream and downstream side of the periphery of the disk, respectively, and wherein the retaining plate comprises teeth exerting the axial pressure against the side end face of the attachment member without contacting the first side end face of the disk.

2. A turbine wheel according to claim 1, wherein the axial pressure between the blades and the disk is provided and maintained without encroaching on the axial clearance between the rotor and an adjacent stator.

3. A turbine wheel according to claim 1, wherein the retaining plate presents extra thickness at its periphery, thereby forming a cantilevered-out mass.

4. A turbine wheel according to claim 1, wherein the retaining plate is mounted on the rotor by being prevented from moving axially by a retaining split ring.

5. A turbine wheel according to claim 4, wherein at least one opening forming an inspection window is formed in the rotor to enable positioning of the retaining split ring to be inspected visually.

6. A turbine wheel according to claim 1, wherein the retaining plate presses against the attachment members of the blades with prestress.

7. A turbine wheel according to claim 1, wherein the retaining plate has a radial dimension that is limited so as to press only against the lower portions of the attachment members of the blades.

8. A turbomachine including a turbine wheel according to claim 1.

* * * * *